US007610642B2

(12) United States Patent
Boyd

(10) Patent No.: US 7,610,642 B2
(45) Date of Patent: Nov. 3, 2009

(54) AIR MATTRESS WITH PILLOW TOP

(76) Inventor: Dennis Boyd, 14457 Rouge River, Chesterfield, MO (US) 63017

( * ) Notice: Subject to any disclaimer, the term of this patent is extended or adjusted under 35 U.S.C. 154(b) by 81 days.

(21) Appl. No.: 11/839,454

(22) Filed: Aug. 15, 2007

(65) Prior Publication Data

US 2008/0078032 A1 Apr. 3, 2008

Related U.S. Application Data

(63) Continuation-in-part of application No. 11/563,351, filed on Nov. 27, 2006, now Pat. No. 7,367,073, which is a continuation of application No. 10/032,872, filed on Dec. 26, 2001, now Pat. No. 7,152,264, which is a continuation of application No. 09/821,932, filed on Mar. 30, 2001, now Pat. No. 6,983,502.

(51) Int. Cl.
*A47C 27/10* (2006.01)

(52) U.S. Cl. ..... 5/712; 5/711; 5/710

(58) Field of Classification Search ..... 5/706, 5/709–712, 682

See application file for complete search history.

(56) References Cited

U.S. PATENT DOCUMENTS

| | | | | |
|---|---|---|---|---|
| 2,604,641 | A | 7/1952 | Reed | |
| 3,042,941 | A | 7/1962 | Marcus | |
| 3,251,075 | A | 5/1966 | Saltness et al. | |
| 3,644,950 | A | 2/1972 | Lindsay, Jr. | |
| 3,772,717 | A * | 11/1973 | Yuen et al. | 5/422 |
| 3,879,776 | A | 4/1975 | Solen | |
| 4,225,989 | A | 10/1980 | Corbett et al. | |
| 4,371,997 | A | 2/1983 | Mattson | |
| 4,424,600 | A | 1/1984 | Callaway | |
| 4,803,744 | A | 2/1989 | Peck et al. | |
| 4,896,389 | A | 1/1990 | Chamberland | |
| 5,044,030 | A | 9/1991 | Balaton | |
| 5,072,469 | A | 12/1991 | Boyd | |
| 5,107,557 | A | 4/1992 | Boyd | |
| 5,115,526 | A | 5/1992 | Boyd | |
| 5,243,722 | A | 9/1993 | Gusakov | |
| 5,423,094 | A | 6/1995 | Arsenault et al. | |
| 5,490,295 | A | 2/1996 | Boyd | |
| 5,493,742 | A | 2/1996 | Klearman | |
| 5,566,408 | A | 10/1996 | McCarthy et al. | |
| 5,598,593 | A | 2/1997 | Wolfe | |
| 5,630,237 | A | 5/1997 | Ku | |
| 5,638,565 | A | 6/1997 | Pekar | |

(Continued)

*Primary Examiner*—Michael Trettel
(74) *Attorney, Agent, or Firm*—H. Frederick Rusche; Husch Blackwell Sanders LLP

(57) ABSTRACT

An air mattress includes an inflatable compartment having a length and width, when inflated, sufficient to support a human body; and having a top, bottom, and non-vertical sides, said top and bottom being generally parallel to one another and being composed of at least two horizontal layers of vinyl, one layer of vinyl forming the top of the compartment and the second forming the bottom; at least one internal, generally vertical wall connected to and restraining the relative vertical movement of the top and bottom of the inflatable compartment; and the sides being connected at least at a first location to and horizontally restrained by the internal, generally vertical wall and forming an indentation in the sides of the mattress. Alternately, the mattress profile is formed by a connection between the sides and at least one internal horizontal layer.

50 Claims, 10 Drawing Sheets

U.S. PATENT DOCUMENTS

| | | | | |
|---|---|---|---|---|
| 5,647,078 | A | 7/1997 | Pekar | |
| 5,647,079 | A | 7/1997 | Hakamiun et al. | |
| 5,711,041 | A | 1/1998 | Chen | |
| 5,727,270 | A | 3/1998 | Copet et al. | |
| 5,740,573 | A | 4/1998 | Boyd | |
| 5,890,245 | A | 4/1999 | Klearman et al. | |
| 6,073,291 | A | 6/2000 | Davis | |
| 6,148,461 | A | 11/2000 | Cook et al. | |
| 6,332,760 | B1 | 12/2001 | Chung | |
| 6,568,011 | B2 | 5/2003 | Fisher et al. | |
| 6,618,884 | B1 | 9/2003 | Wu | |
| 6,701,559 | B2 | 3/2004 | Boso et al. | |
| 6,954,957 | B2 | 10/2005 | Metzger et al. | |
| 6,966,090 | B2 | 11/2005 | McClintock et al. | |
| 7,007,329 | B2 | 3/2006 | Metzger | |
| 7,152,264 | B2 | 12/2006 | Boyd | |
| 7,165,283 | B2 * | 1/2007 | Boso et al. | 5/739 |
| 7,353,555 | B2 * | 4/2008 | Lau | 5/711 |

* cited by examiner

AIR MATTRESS WITH PILLOW TOP

CROSS-REFERENCE TO RELATED APPLICATIONS

This application claims the priority of application Ser. No. 11/563,351, filed Nov. 27, 2006, now U.S. Pat. No. 7,367,073, which is a continuation of application Ser. No. 10/032,872, filed Dec. 26, 2001, now U.S. Pat. No. 7,152,264, which is, in turn, a continuation of application Ser. No. 09/821,932, filed Mar. 30, 2001 and now U.S. Pat. No. 6,983,502.

STATEMENT REGARDING FEDERALLY SPONSORED RESEARCH OR DEVELOPMENT

Not applicable.

BACKGROUND OF THE INVENTION

This invention relates generally to air mattresses and more particularly to an air mattress with an second inflatable layer on top to provide a "pillow top" appearance and feel to the mattress.

The standard air mattress also could be improved in appearance and feel. The single vinyl top sheet of these mattresses is rather typically plain and flat in appearance, even with a pattern embossed thereon. Conventional mattresses, on the other hand, traditionally have a tufted or quilted appearance which people find attractive.

Moreover, conventional mattresses often have a different feel to the user than that achieved with conventional air mattresses. Such mattresses could be more acceptable with a better feel.

SUMMARY OF THE INVENTION

Among the various features of the present invention may be noted the provision of an air mattress in which the comfort is improved.

Another feature is the provision of such an air mattress with an improved appearance.

A third feature is the provision of such an air mattress with increased versatility.

Other objects and features will be in part apparent and in part pointed out hereinafter.

Briefly, in its broadest aspect an air mattress of the present invention includes an inflatable compartment having a length and width, when inflated, sufficient to support a human body; and having a top, bottom, and non-vertical sides, said top and bottom being generally parallel to one another and being composed of at least two horizontal layers of vinyl, one layer of vinyl forming the top of the compartment and the second forming the bottom; at least one internal, generally vertical wall connected to and restraining the relative vertical movement of the top and bottom of the inflatable compartment; and the sides being connected at least at a first location to and horizontally restrained by the internal, generally vertical wall and forming an indentation in the sides of the mattress.

In an alternate embodiment, the air mattress includes a first inflatable compartment having a length and width, when inflated, sufficient to support a human body; the first inflatable compartment having a top, bottom, and non-vertical sides, with the top and bottom being generally parallel to one another; at least a first internal, generally vertical wall connected to and restraining the relative vertical movement of said top and bottom of the first inflatable compartment; a second inflatable compartment disposed on the top of the first inflatable compartment and secured thereto, said second inflatable compartment having a length and width, when inflated, sufficient to support a human body; the second inflatable compartment having a top, bottom, and non-vertical sides, the top and bottom being generally parallel to one another; wherein said top and the non-vertical sides of the first inflatable compartment are connected to said bottom and said non-vertical sides of said second inflatable compartment at least at a first location along a periphery of the top of said first inflatable compartment and the bottom of the second inflatable compartment; and wherein the non-vertical sides of the first inflatable compartment and the non-vertical sides of said second inflatable compartment are arranged at an angle of less than 180° relative to one another, thereby forming an indentation in the air mattress.

BRIEF DESCRIPTION OF THE DRAWINGS

Similar reference characters indicate similar parts throughout the several views of the drawings.

DESCRIPTION OF THE PREFERRED EMBODIMENT

Figure 1:
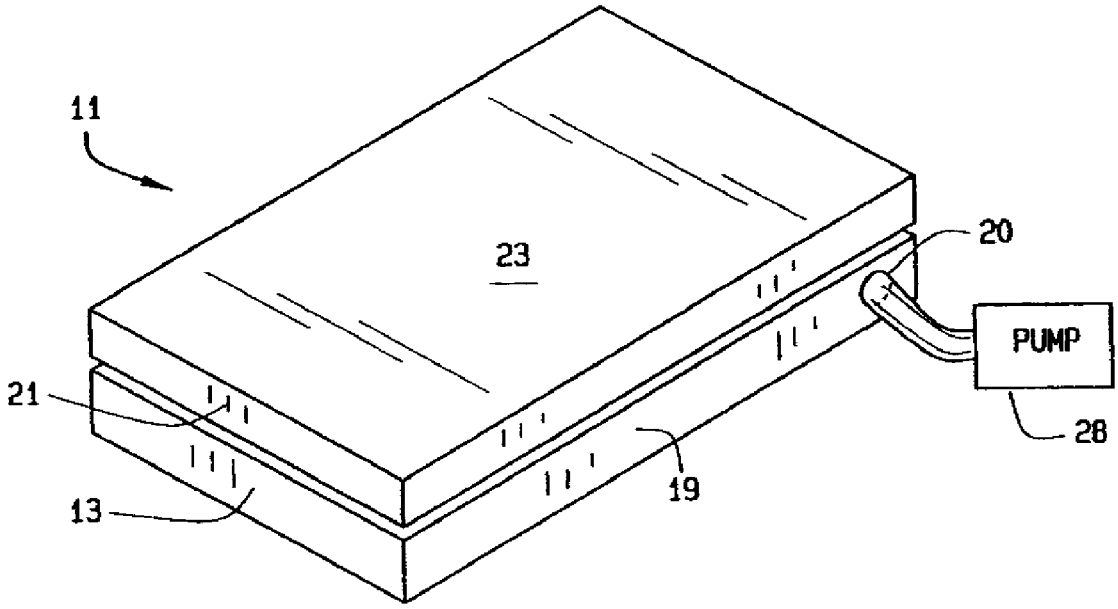
FIG. 1 is a perspective view illustrating the air mattress of the present invention.
Figure 2:
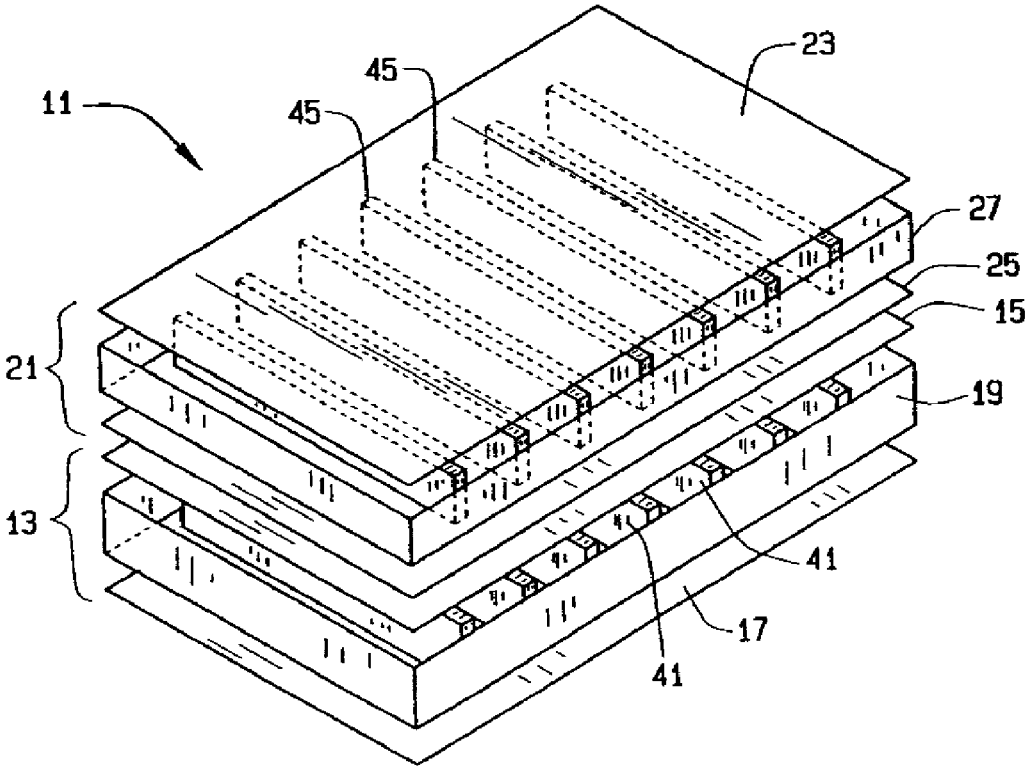
FIG. 2 is an exploded perspective view of the air mattress of FIG. 1.

Turning to the drawings and more specifically to FIGS. 1 and 2, an air mattress 11 of the present invention includes a first inflatable compartment 13 having a length and width, when inflated, sufficient to support a human body. Compartment 13 is composed of a first vinyl sheet 15 forming a top of the compartment, a second vinyl sheet 17 forming a bottom of the compartment, and a vinyl strip 19 forming the sides of the compartment. Preferably the first inflatable compartment 13 may be inflated by means of a standard inflate, or inflate/deflate, valve 20 disposed at a convenient location in the wall of compartment 13.

Figure 3:
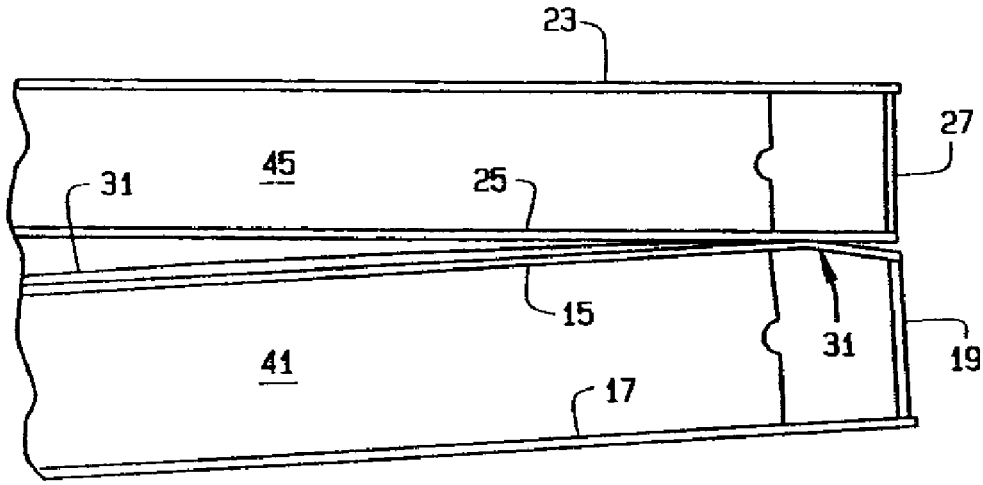
FIG. 3 is a partial sectional view, with parts broken away for clarity, of the air mattress of FIG. 1.
Figure 4:
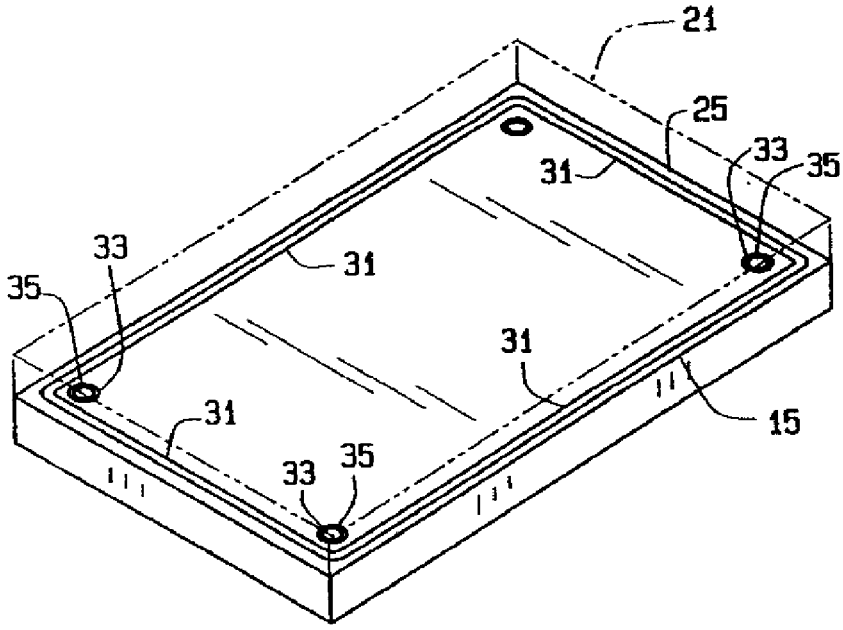
FIG. 4 is a perspective view of a portion of the air mattress of the present invention, showing the seal between the top and bottom compartments of the air mattress.

Air mattress 11 also includes a second inflatable compartment 21 disposed on the top of the first inflatable compartment 13 and secured thereto at least along a portion of the first inflatable compartment (as is shown in FIGS. 3 and 4). Second compartment 21 extends generally the length and width of the top 15 of the first compartment 13 and is of a size, when inflated, sufficient to support a human body. The second compartment 21 is composed of a first vinyl layer 23 forming the top of the second compartment, a second vinyl layer 25 forming the bottom of the second compartment, and a vinyl strip 27 forming the sides of the second compartment. The second compartment is inflatable to give the top of the air mattress a soft, pillow-like appearance and feel. It is preferred that the top of second compartment 21 include a soft, non-vinyl fabric or surface secured thereto.

FIG. 1 also shows an optional pump 28 that may be used to inflate or inflate/deflate the compartments. The pump may be attached permanently to valve 20, if desired, or may be attached temporarily to the valve by the user.

As can be seen more clearly in FIGS. 3 and 4, the first and second compartments are secured together along, but spaced inwardly from, the perimeter. This is shown most clearly in FIG. 4 where the perimeter seal is labeled 31. For example, the perimeter seal 31 may be recessed approximately one inch from the edge of the mattress. This seal connects the top vinyl layer 15 of the first compartment to the bottom vinyl layer 25 of the second compartment. In addition, the compartments are sealed together (at seals 33) adjacent a plurality of holes 35 that provide fluid communication channel connecting the first and second compartments. Of course, if desired, the first and second compartments should also be secured together at other places. The seals may be formed using any known sealing method.

It is preferred that the compartments have a single inflation/deflation valve 20, and that (in the embodiment shown in FIG. 1) the inflation air for the second compartment flow initially into the first compartment. Of course, the single inflation/deflation valve could be disposed in a wall of the second compartment instead, in which case inflating air flow would be from the second compartment to the first.

As can be seen in FIGS. 2 and 3, the vinyl layers of the first compartment are held together along the perimeter by vinyl strip 19 and internally by a plurality of spaced ribs 41. Ribs 41 are preferably formed of vinyl, extend transversely across the compartment, and are sealed to the vinyl layers of the first compartment along their length. The ribs are preferably notched on each end as shown in FIG. 3 and terminate short of seal 31. This provides for air flow around the ribs and permits the portions of the compartments outboard of the seal 31 to flex relatively independently of each other.

Similarly, second compartment 21 includes a plurality of ribs 45 that serve the same functions for the second compartment that ribs 41 serve for the first compartment. It is preferred that first compartment 13 be somewhat taller, when inflated, than second compartment 21. For this reason, ribs 41 are preferably taller than ribs 45. For example, ribs 41 can be approximately four inches in height, while ribs 45 would be approximately three includes in height. Other dimensions could of course be used.

The construction of air mattress 11 as shown in the drawings leaves the first and second compartments substantially free to move with respect to each other except at their periphery. Specifically, sealing the compartments together substantially only along the exterior portion allows the inner portions of the compartments to move substantially with respect to one another, thereby improving the feel of the mattress. Similarly, the fact that the primary seal 31 is recessed from the periphery of the two compartments permits limited relative movement of the second compartment with respect to the first compartment along the edge of the mattress.

Figure 5A:
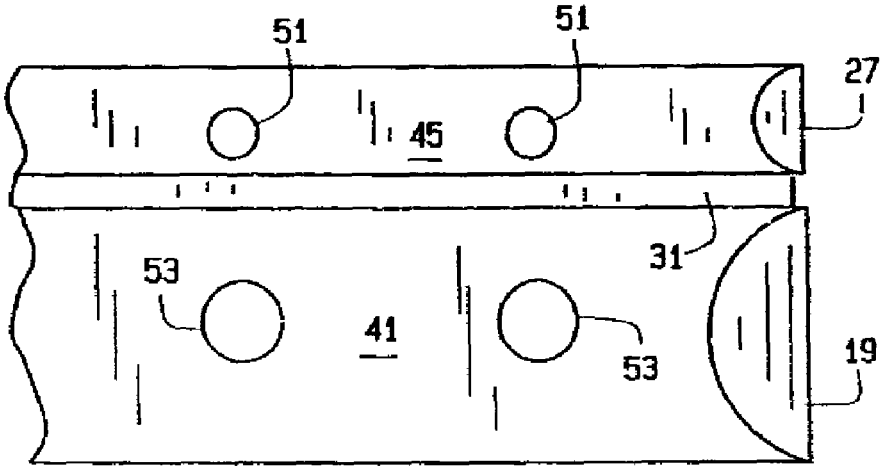
FIGS. 5A-5C show variations in the pillow top of the present invention.
Figure 5B:
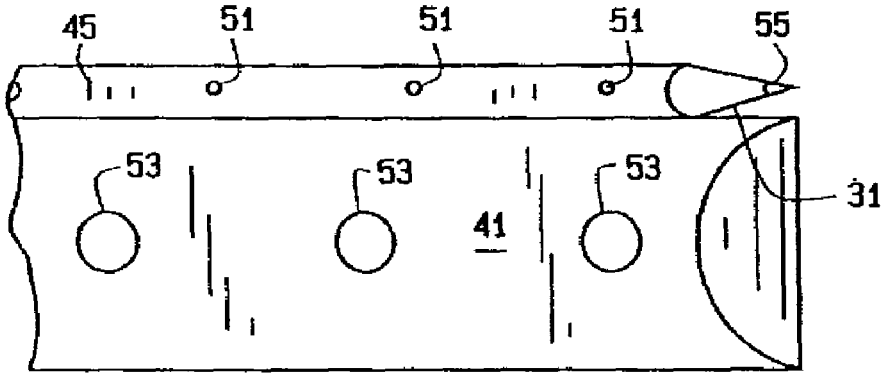
Figure 5C:
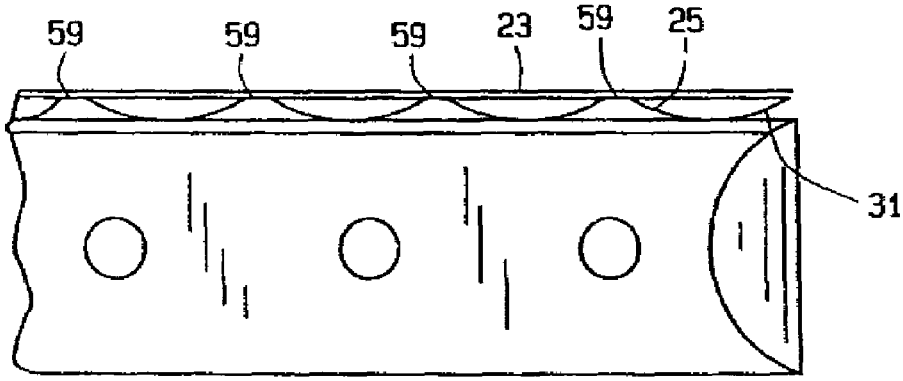

Turning to FIGS. 5A-5C, there are shown certain variations in the pillow top of the present invention. FIG. 5A illustrates in simplified form the construction of FIG. 3, with the addition of a plurality of holes 51 and 53 through ribs 45 and 41 respectively. This holes provide increased airflow back and forth in the two compartments. It should be appreciated that the second compartment in this construction has two seams and forms a gusset.

FIG. 5B illustrates a similar construction in which the top (second) compartment is constructed with a seam 55 in its vertical wall. This construction provides a more two-dimensional pillow top appearance (as opposed to the three-dimensional effect of the construction of FIG. 5A). Similarly, FIG. 5C illustrates another two-dimensional-type construction in which the top layer 23 of second compartment 21 and the bottom layer 25 of that compartment are joined together by discontinuous seals 59. For example, each seal could be a circle, or could run for only a few inches or so. Air in the second compartment in this construction flows around the seals 59. This construction provides a pleasing, tufted appearance to the pillow top of the mattress.

Figure 6A:
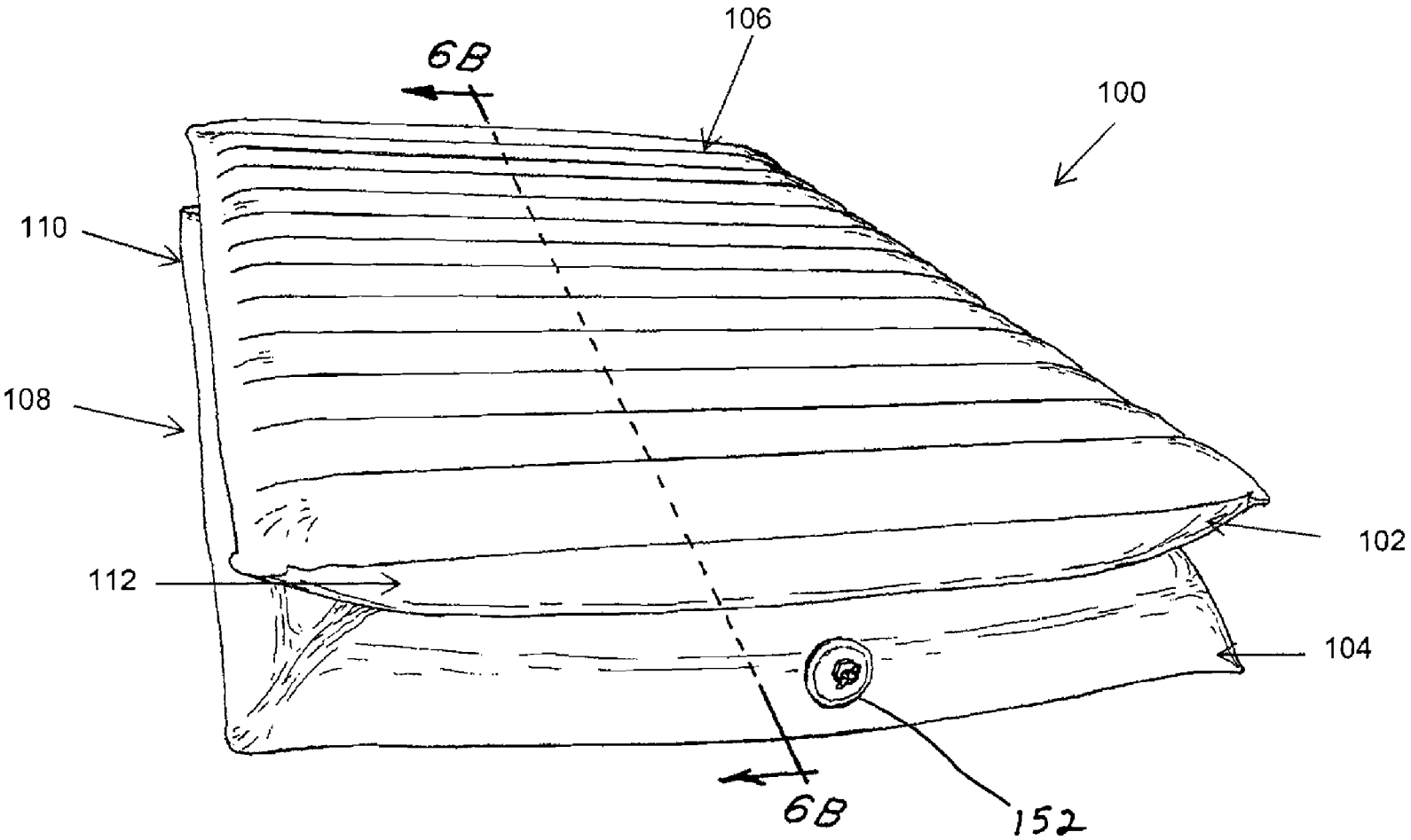
FIG. 6A illustrates another embodiment of an air mattress according to the present invention.
Figure 6B:
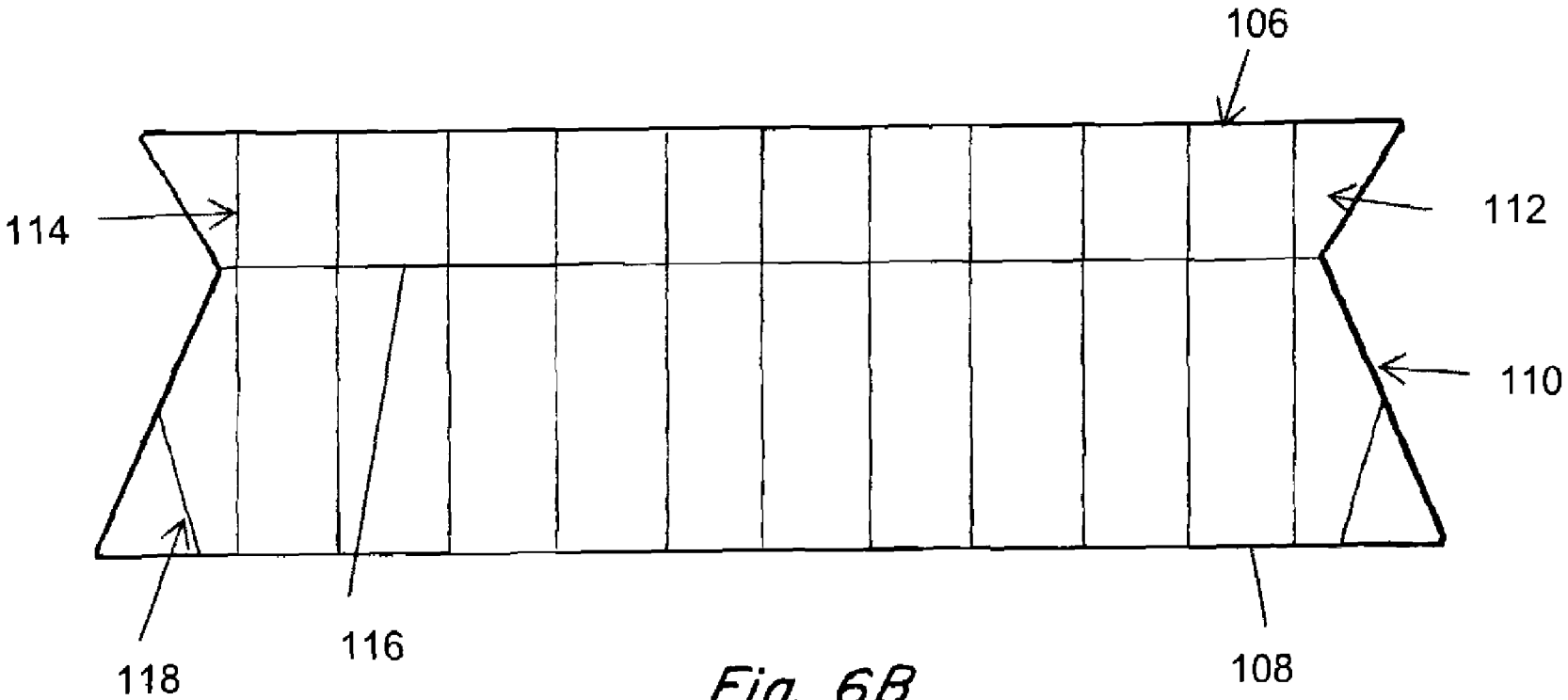
FIG. 6B is a partial sectional view of the mattress of FIG. 6A.

FIGS. 6A and 6B illustrate an air mattress 100 utilizing a slightly different construction. The mattress 100 includes top 102 and bottom 104 compartments. The compartments are formed from a top layer 106 and bottom layer 108, sides 110, 112, and an intermediate boundary 116. Sides 110, 112 may be formed from a single piece or separate pieces. Further, the intermediate boundary 116 may comprise a single layer forming the top of the second 104 compartment and the bottom of the first 102 compartment or separate layers. A seam joins the intermediate boundary 116 to the sides 110, 112, as shown in FIG. 6B. The intermediate boundary 116 is provided with length and width dimensions that are preferably less than the corresponding dimensions of both the top 106 and bottom 108 layers. This arrangement results in the sides 110, 112 having an angular orientation relative to vertical and creating an indentation in the sides of the mattress, which enhances the pillowtop appearance of the mattress. The seam joining the intermediate boundary 116 and the sides 110, 112, is shown in FIGS. 6A and 6B as being somewhat above the approximate midpoint of the mattress's height. However, alternate embodiments in which this joining point is located at or below the midpoint of the mattress are also contemplated as being within the scope of the present invention. In another embodiment, the bottom layer 108 has a height and width somewhat greater than that of the top layer 106 to create a support base that minimizes possible tipping of the mattress when a user lies or sits near an edge of the mattress. The intermediate boundary 116 may be provided with vents to allow air to flow between the top 102 and bottom 104 compartments.

FIG. 6B illustrates the additional internal structures that may be used with this embodiment. These additional structures are not essential to the mattress but do provide additional stability. These internal structures may include a series of ribs 114 or cylinders connecting the top layer 106 to the intermediate boundary 116 and the intermediate boundary 116 to the bottom layer 108. Secondary support beams 118 that connect the sides 110 to the bottom layer 108 may also be utilized. Those of skill in the art will recognize that there are numerous additional internal support structures that may be utilized in combination with the basic structure of this mattress as described above.

Figure 7A:
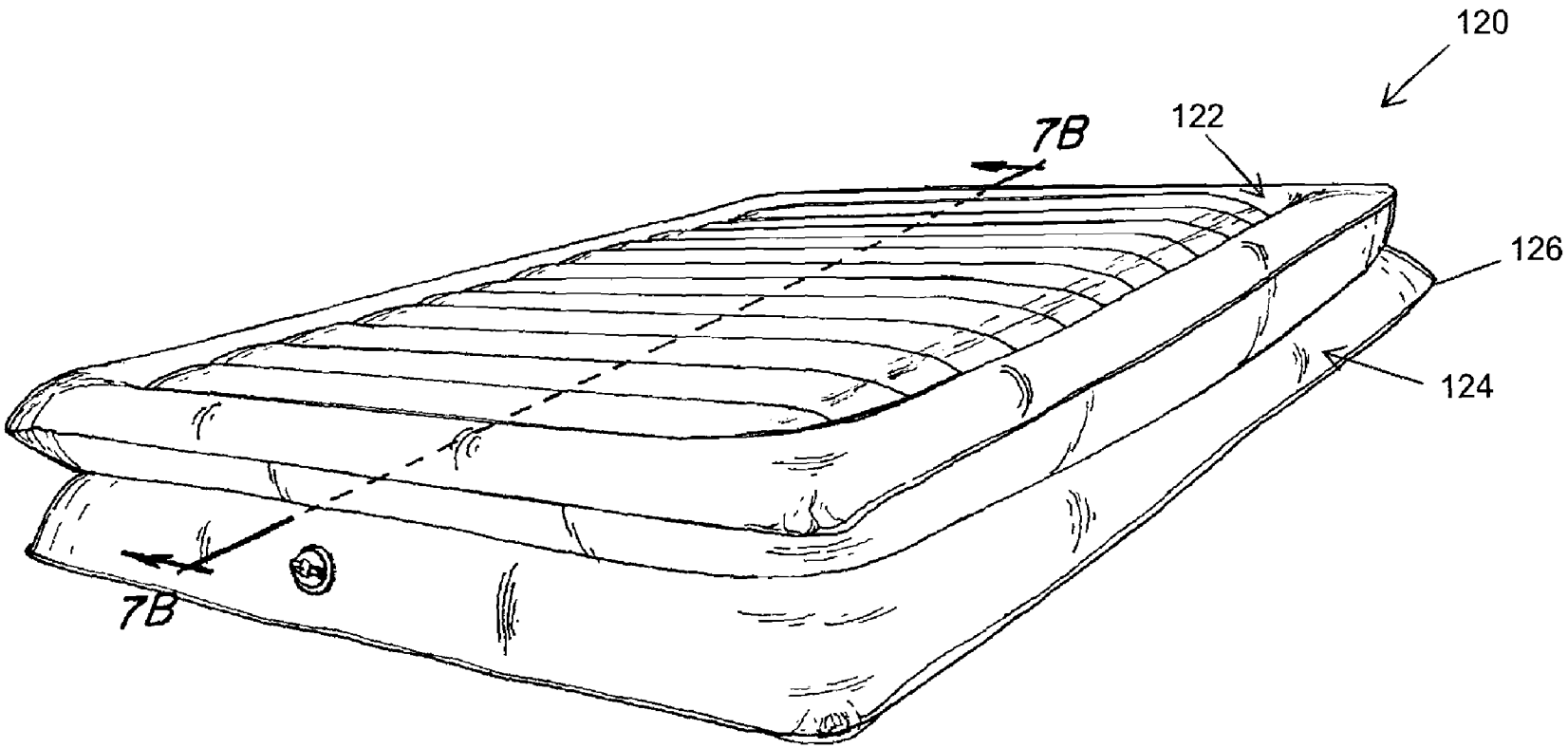
FIG. 7A illustrates another embodiment of an air mattress according to the present invention.

FIG. 7A illustrates a mattress having a similar profile to that of the mattress of FIG. 6A. As with the previous embodiment, the mattress 120 of FIG. 7A has a profile that includes slightly angular sides 126 forming an indentation around the mattress between the top 122 and bottom layers 124. However, the mattress of FIG. 7A is a single compartment or chamber design that does not have an intermediate boundary. Thus, this embodiment provides the appearance of a pillowtop mattress at a lower cost. As shown in the cross-sectional view of FIG. 7B, a continuous beam 128 extends generally around the complete perimeter of the mattress and connects the mattress's top 122 and bottom 124 layers. This beam 128 is also joined by a seam to the sides 126. The beam is connected to each of the top and bottom layers at a point recessed from the edges of those layers. This arrangement causes the connection of the beam 128 and the sides 126 to pull the sides 126 slightly inward, thereby creating the slightly angled walls and indentation previously mentioned without the use of an intermediate horizontal layer. The bottom layer 124 may be provided with a height and width somewhat greater than that of the top layer 122 to create a support base that minimizes possible tipping of the mattress when a user lies or sits near an edge of the mattress. As with the previous embodiment, various additional internal support structures are possible to provide additional stability to the mattress. In the embodiment shown in FIGS. 7A and 7B, a series of internal vertical walls 130 formed into rounded rectangles connects the top 122 and bottom 124 layers.

Figure 8A:
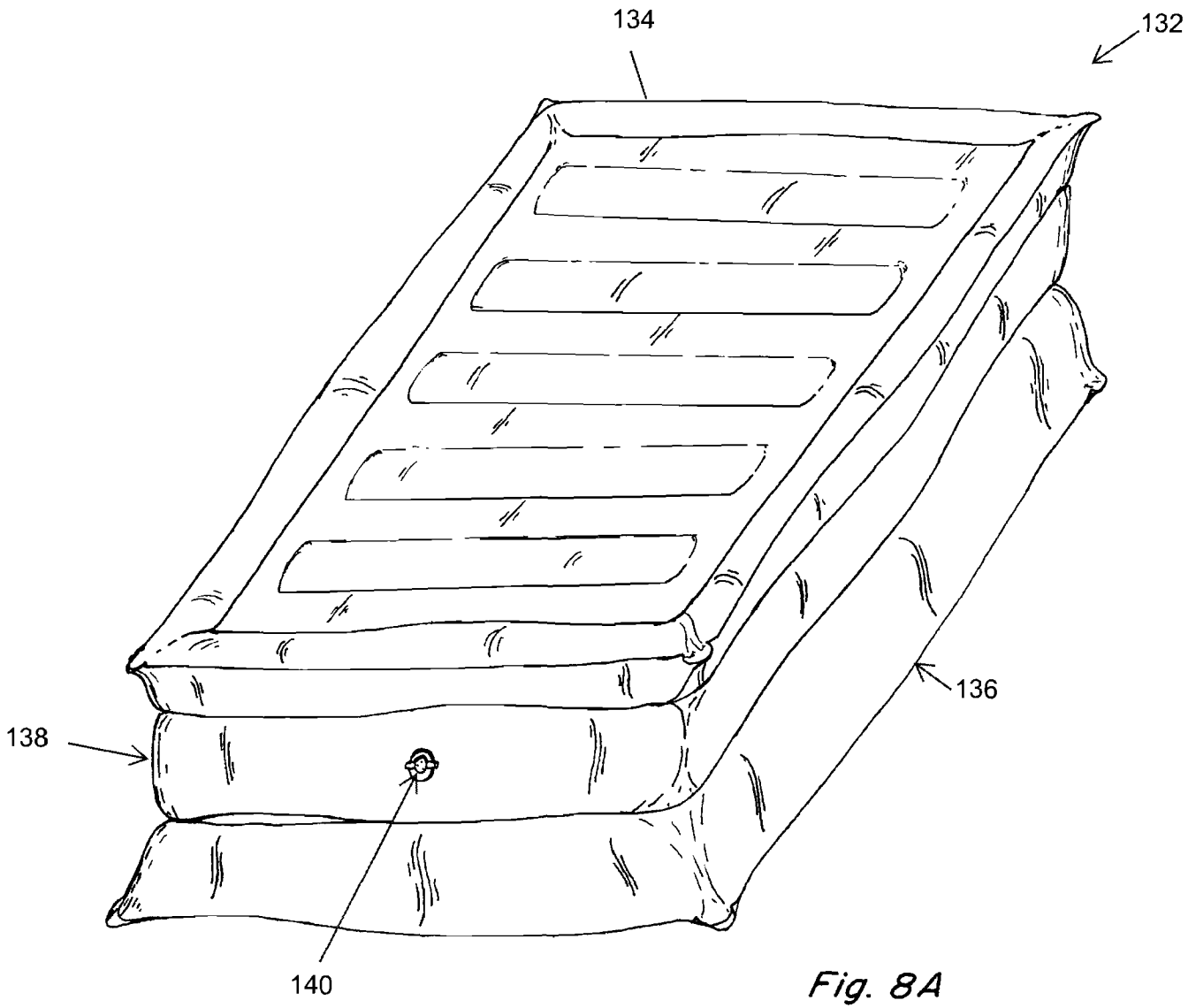
FIG. 8A illustrates another embodiment of an air mattress according to the present invention.
Figure 8B:
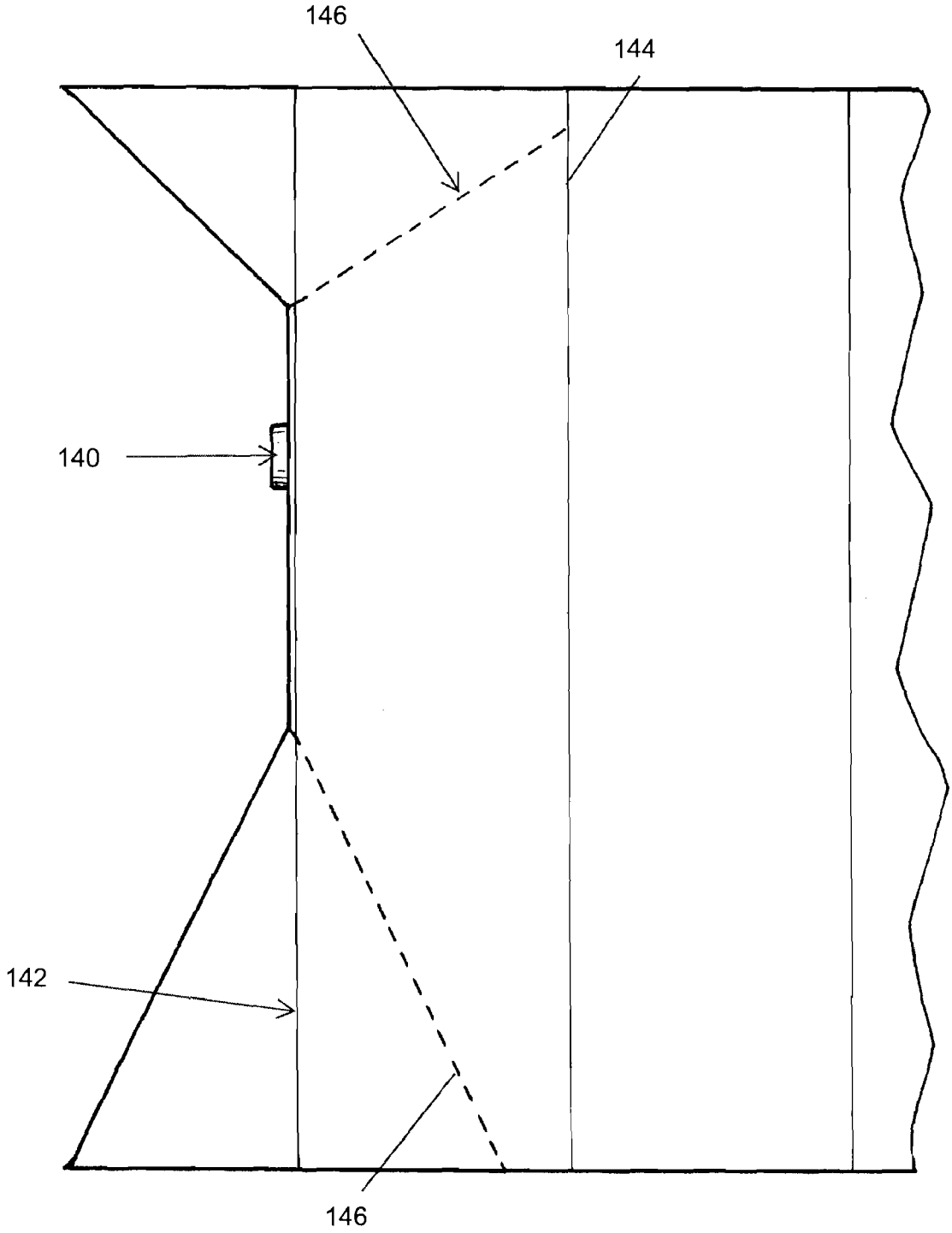
FIG. 8B is a partial sectional view of the mattress of FIG. 7A.
Figure 8C:
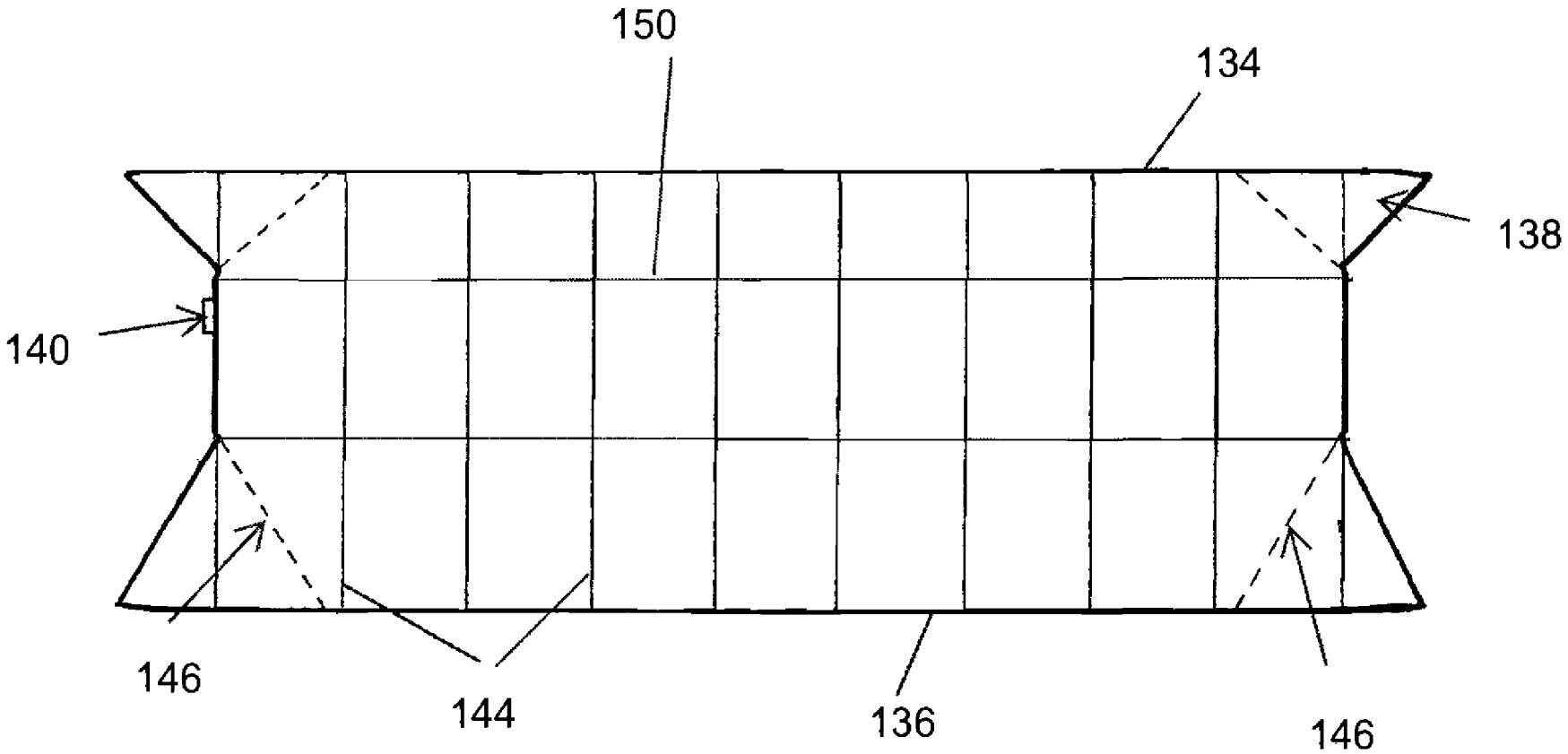
FIG. 8C is a partial sectional view of a mattress incorporating a variation on the structure of the mattress of FIG. 7A.

FIGS. 8A-8C illustrate a variation on the above embodiments in the mattress 132 has a different profile in which the sides 138 of the mattress generally include three sections, two slightly angular sections and a generally vertical middle section, created by the internal structure of the mattress. The generally vertical middle section of the sides provides an advantageous mounting location for a valve 140 for the mattress. As with the previous embodiments, the bottom layer 136 of the mattress may be provided with a height and width somewhat greater than that of the top layer 134 to create a support base that minimizes possible tipping of the mattress when a user lies or sits near an edge of the mattress.

Figure 7B:
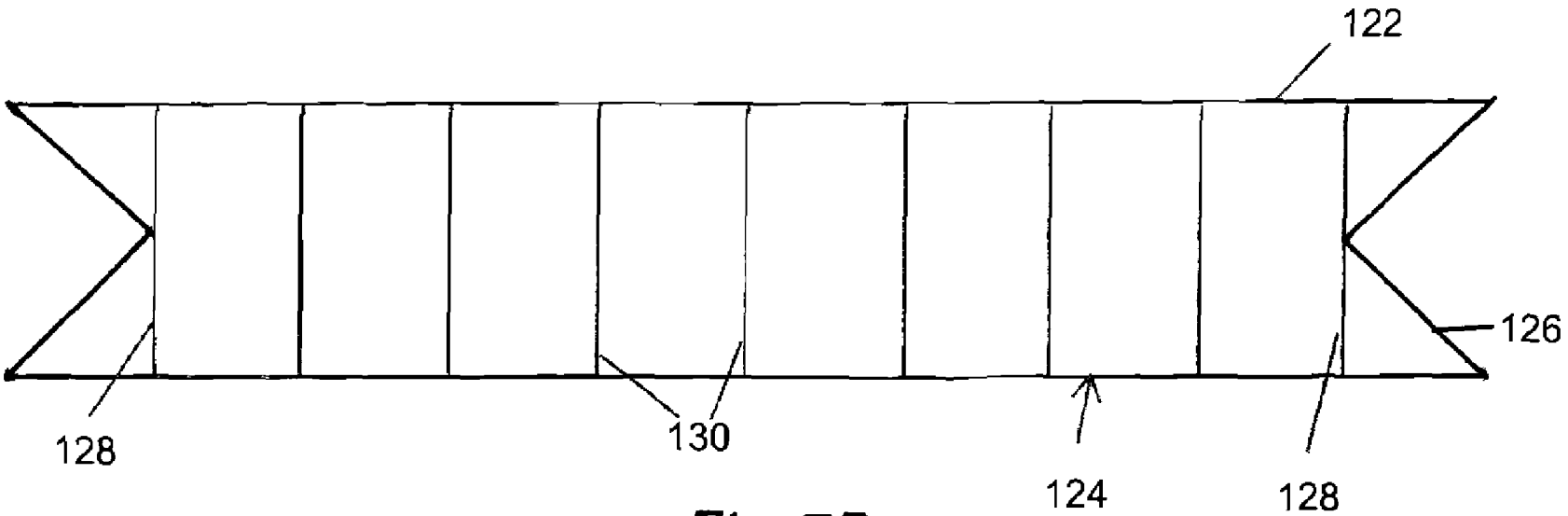
FIG. 7B is a partial sectional view of the mattress of FIG. 7A.

FIG. 8B shows a cross-sectional view of one arrangement associated with this embodiment that is similar to the internal structure of the mattress shown in FIGS. 7A and 7B. The mattress includes a continuous beam 142 that extends generally around the complete perimeter of the mattress and connects the mattress's top 134 and bottom 136 layers. This beam 142 is joined by two seams to the sides 138. The beam is connected to each of the top and bottom layers at a point recessed from the edges of those layers. This arrangement causes the connection of the beam 142 and the sides 138 to pull the sides 138 slightly inward at two positions, thereby creating the slightly angled sections and generally vertical middle section. A series of walls 144 connecting the top 134 and bottom 136 layers may also be incorporated for additional stability. However, once again, numerous internal support structures known to those of skill in the art are suitable for use with the basic structure described. In addition, to walls 144, secondary support beams 146 connecting the continuous beam 142 and the top 134 and bottom 136 layers (or the outer most walls 144) may be used to minimize "bowing out" of the sides 138 of the mattress.

FIG. 8C illustrates a variation of the embodiment having three compartments or chambers formed from at least four horizontal layers, including the top 134, bottom 136, and intermediate 148, 150 layers. The intermediate layers 148, 150 are preferably provided with heights and widths that are somewhat less than the corresponding dimensions of the top 134 and bottom 136 layers. The intermediate layers 148, 150 are connected at slightly spaced apart points to the sides 138 of the mattress to create a profile similar to the previously described mattress. The intermediate layers may be provided with vents or passages to allow the flow of air between adjacent chambers.

As illustrated in FIG. 6A, the indentation created in the profile of the above described embodiments provides an advantageous location for an integrated air pump for these mattresses. In a preferred embodiment, the air pump 152 is mounted within the confines of the indention and has an external depth less than a depth of said indention.

It should be appreciated that the air mattress of the present invention may be constructed in various sizes and shapes. It may be packaged and sold or stored in a bag, if desired.

In view of the above it will be seen that the various objects and features of the invention are achieved and other advantageous results obtained. The examples contained herein are merely illustrative and are not intended in a limiting sense.

What is claimed is:

1. An air mattress comprising:

an inflatable compartment having a length and width, when inflated, sufficient to support a human body;

said inflatable compartment having a top, bottom, and non-vertical sides, said top and bottom being generally parallel to one another;

said inflatable compartment being composed of at least two horizontal layers of vinyl, one layer of vinyl forming the top of the compartment and the second forming the bottom;

at least one internal, generally vertical wall connected to and restraining the relative vertical movement of said top and bottom of said inflatable compartment; and at least one of said sides being generally oriented in the same direction as said internal, generally vertical wall and connected at least at a first location to and horizontally restrained by said internal, generally vertical wall, a portion of said side being pulled inwardly by said connection with said internal, generally vertical wall thereby forming a horizontal indentation in said side between said top and bottom.

2. The air mattress as set forth in claim 1, wherein said internal, generally vertical wall is arranged in a cylindrical pattern between said top and bottom.

3. The air mattress as set forth in claim 1, wherein said internal, generally vertical wall is arranged in an oval pattern between said top and bottom.

4. The air mattress as set forth in claim 1, further comprising at least a second internal, generally vertical wall and wherein said internal, generally vertical walls are arranged in a linear pattern between said top and bottom and are parallel to one another.

5. The air mattress as set forth in claim 1, wherein said sides are further connected at least at a second location to said internal, generally vertical wall.

6. The air mattress as set forth in claim 1, said bottom of said inflatable compartment having at least one horizontal dimension greater than a corresponding horizontal dimension of said top.

7. The air mattress as set forth in claim 1, said bottom of said inflatable compartment having a greater width and a greater length than said top.

8. The air mattress as set forth in claim 1, wherein said at least one of said top, bottom, and sides is formed from a different color material than the remaining pieces.

9. The air mattress as set forth in claim 1, wherein at least one of said top, bottom, and sides further comprises a flocked material.

10. The air mattress as set forth in claim 1, wherein at least one of said top, bottom, and sides further comprises a fabric material.

11. The air mattress as set forth in claim 1, wherein at least one of said top, bottom, and sides further comprises a non-vinyl material laminated thereto.

12. The air mattress as set forth in claim 1, wherein said at least one location of connection between said sides and said internal, generally vertical wall occurs at a point higher than the midpoint of said internal, generally vertical wall.

13. The air mattress as set forth in claim 1, wherein said at least one location of connection between said sides and said internal, generally vertical wall occurs at a point lower than the midpoint of said internal, generally vertical wall.

14. The air mattress as set forth in claim 1, wherein said at least one location of connection between said sides and said internal, generally vertical wall occurs at about the midpoint of said internal, generally vertical wall.

15. The air mattress as set forth in claim 1, further comprising an air pump associated with said air mattress.

16. The air mattress as set forth in claim 15 wherein said air pump is mounted to said air mattress.

17. The air mattress as set forth in claim 15, wherein said air pump is removably connectable to said air mattress.

18. The air mattress as set forth in claim 1, further comprising at least one internal, non-vertical support beam connected to said sides and at least one of said top and bottom of said inflatable compartment.

19. The air mattress as set forth in claim 1, wherein said sides are further comprised of at least two pieces of material.

20. The air mattress as set forth in claim 1, wherein said at least two pieces of material are positioned in a vertical relationship relative to one another.

21. The air mattress as set forth in claim 1, further comprising an air pump mounted in said indention, said air pump have an external depth less than a depth of said indention.

22. An air mattress comprising:

a first inflatable compartment having a length and width, when inflated, sufficient to support a human body;

said first inflatable compartment having a top, bottom, and non-vertical sides, said top and bottom being generally parallel to one another, said top of said first inflatable compartment being smaller in at least one of its width and length than said bottom of said first inflatable compartment;

at least a first internal, generally vertical wall connected to and restraining the relative vertical movement of said top and bottom of said first inflatable compartment;

a second inflatable compartment disposed on the top of said first inflatable compartment and secured thereto, said second inflatable compartment having a length and width, when inflated, sufficient to support a human body;

said second inflatable compartment having a top, bottom, and non-vertical sides, said top and bottom being generally parallel to one another, said bottom of said first inflatable compartment being smaller in at least one of its width and length than said top of said first inflatable compartment;

wherein said top and said non-vertical sides of said first inflatable compartment are connected to said bottom and said non-vertical sides of said second inflatable compartment at least at a first location along a periphery of said top of said first inflatable compartment and said bottom of said second inflatable compartment; and wherein said non-vertical sides of said first inflatable compartment and said non-vertical sides of said second inflatable compartment are arranged at an angle of less than 180° relative to one another, thereby forming a horizontal indentation in said air mattress between said bottom of said first inflatable compartment and said top of said second inflatable compartment.

23. The air mattress of claim 22, wherein said first inflatable compartment is composed of at least two horizontal layers of vinyl, one layer of vinyl forming the top of said first inflatable compartment and the second forming said bottom of said first inflatable compartment; and wherein said second inflatable compartment is composed of at least two additional horizontal layers of vinyl distinct from the two layers of vinyl composing said first inflatable compartment.

24. The air mattress of claim 22, wherein said first inflatable compartment is composed of at least two horizontal layers of vinyl, the first layer of vinyl forming the top of said first inflatable compartment and the second forming said bottom of said first inflatable compartment; and wherein said second inflatable compartment is composed of at least one additional horizontal layer of vinyl, said additional layer of horizontal layer of vinyl forming said top of said second inflatable compartment, said first horizontal layer of vinyl forming said bottom of said second inflatable compartment as well as forming said top of said first inflatable compartment.

25. The air mattress of claim 22, wherein said top of said first inflatable compartment and said bottom of said second inflatable compartment have at least one of a length and a width that is less than a corresponding dimension of said bottom of said first inflatable compartment and said top of said second inflatable compartment.

26. The air mattress of claim 25, wherein at least one of said length and said width of said top of said first inflatable compartment and said bottom of said second inflatable compartment is at least two inches less than said corresponding dimension of said bottom of said first inflatable compartment and said top of said second inflatable compartment.

27. The air mattress of claim 22, wherein said indentation is at least two inches in depth.

28. The air mattress as set forth in claim 22, wherein said first internal, generally vertical wall is arranged in a cylindrical pattern between said top and bottom of said first inflatable compartment.

29. The air mattress as set forth in claim 22, wherein said first internal, generally vertical wall is arranged in an oval pattern between said top and bottom of said first inflatable compartment.

30. The air mattress as set forth in claim 22, further comprising at least a second internal, generally vertical wall between said top and bottom of said first inflatable compartment and wherein said internal, generally vertical walls are arranged in a linear pattern and are parallel to one another.

31. The air mattress as set forth in claim 22, further comprising at least a second internal, generally vertical wall connected to and restraining the relative vertical movement of said top and bottom of said second inflatable compartment.

32. The air mattress as set forth in claim 22, said bottom of said first inflatable compartment having at least one horizontal dimension greater than a corresponding horizontal dimension of said top of said second inflatable compartment.

33. The air mattress as set forth in claim 22, said bottom of said first inflatable compartment having a greater width and a greater length than said top of said second inflatable compartment.

34. The air mattress as set forth in claim 22, wherein said at least one of said top, bottom, and sides of said first and second inflatable compartments is formed from a different color material than the remaining pieces.

35. The air mattress as set forth in claim 22, wherein at least one of said top, bottom, and sides of said first and second inflatable compartments further comprises a flocked material.

36. The air mattress as set forth in claim 22, wherein at least one of said top, bottom, and sides of said first and second inflatable compartments further comprises a non-vinyl material laminated thereto.

37. The air mattress as set forth in claim 22, wherein said non-vertical sides of said first inflatable compartment have a height greater than a height of said non-vertical sides of said second inflatable compartment.

38. The air mattress as set forth in claim 22, wherein said non-vertical sides of said first inflatable compartment have a height less than a height of said non-vertical sides of said second inflatable compartment.

39. The air mattress as set forth in claim 22, wherein said non-vertical sides of said first inflatable compartment have a height approximately equal to a height of said non-vertical sides of said second inflatable compartment.

40. The air mattress as set forth in claim 22, further comprising an air pump associated with said air mattress.

41. The air mattress as set forth in claim 40 wherein said air pump is mounted to said air mattress.

42. The air mattress as set forth in claim 40, wherein said air pump is removably connectable to said air mattress.

43. The air mattress as set forth in claim 22, further comprising at least one internal, non-vertical support beam connected to said sides of and at least one of said top and bottom of said first inflatable compartment.

44. The air mattress as set forth in claim 22, further comprising at least one internal, non-vertical support beam connected to said sides of and at least one of said top and bottom of said second inflatable compartment.

45. The air mattress as set forth in claim 22, further comprising an air pump mounted in said indention, said air pump have an external depth less than a depth of said indention.

46. The air mattress as set forth in claim 22, further comprising air flow passages between said first and second inflatable compartments.

47. An air mattress comprising:

an inflatable compartment having a length and width, when inflated, sufficient to support a human body;

said inflatable compartment having a top, bottom, and non-vertical sides, said top and bottom being generally parallel to one another;

said inflatable compartment being composed of at least two horizontal layers of vinyl, one layer of vinyl forming the top of the compartment and the second forming the bottom;

at least one internal, generally vertical wall connected to and restraining the relative vertical movement of said top and bottom of said inflatable compartment; and an internal, generally horizontal wall located between said top and said bottom, said internal, generally horizontal wall being smaller in at least one of its width and length than said top and said bottom of said inflatable compartment, said internal, generally horizontal wall connected at least at a first location to and horizontally restraining said sides, a portion of said sides being pulled inwardly by said connection with said internal, generally horizontal wall thereby forming a horizontal indentation in said sides between said top and bottom.

48. The air mattress of claim 47, wherein said indentation is at least two inches in depth.

49. The air mattress of claim 47, wherein said internal, generally horizontal wall has at least at least one of a length and a width that is less than a corresponding dimension of said top and bottom of said inflatable compartment.

50. The air mattress of claim 49, wherein at least one of said length and said width of said internal, generally horizontal wall is at least two inches less than said corresponding dimension of said top and said bottom of said inflatable compartment.

* * * * *